US007380959B2

(12) United States Patent
Shotwell et al.

(10) Patent No.: US 7,380,959 B2
(45) Date of Patent: Jun. 3, 2008

(54) MACHINE FOR ILLUMINATING FLUORESCENT ART

(76) Inventors: Kenneth Shotwell, 133 Lay Bridge Rd., Central, SC (US) 29630; Tom Binder, 825 Wilshire Blvd., Suite 708, Santa Monica, CA (US) 90401

( * ) Notice: Subject to any disclaimer, the term of this patent is extended or adjusted under 35 U.S.C. 154(b) by 276 days.

(21) Appl. No.: 10/801,967

(22) Filed: Mar. 15, 2004

(65) Prior Publication Data

US 2006/0232963 A1 Oct. 19, 2006

Related U.S. Application Data

(63) Continuation of application No. 10/160,892, filed on Jun. 3, 2002, now abandoned.

(51) Int. Cl.
*F21V 33/00* (2006.01)

(52) U.S. Cl. ..... 362/231; 362/228; 362/287; 362/427

(58) Field of Classification Search ..... 362/231, 362/228, 249, 252, 241, 240, 806, 250, 219, 362/260, 287, 427, 293, 234, 253; 40/543
See application file for complete search history.

(56) References Cited

U.S. PATENT DOCUMENTS

| | | | | |
|---|---|---|---|---|
| 4,091,441 | A * | 5/1978 | Ott | 362/1 |
| 4,236,192 | A * | 11/1980 | Duggan | 362/133 |
| 6,164,803 | A * | 12/2000 | Reniger et al. | 362/477 |
| 6,174,078 | B1 * | 1/2001 | Ohm et al. | 362/477 |
| 6,474,851 | B1 * | 11/2002 | Baley | 362/477 |
| 7,018,081 | B2 * | 3/2006 | Hopkins | 362/477 |

FOREIGN PATENT DOCUMENTS

JP 2000-364303 6/2002

* cited by examiner

*Primary Examiner*—Thomas M. Sember
(74) *Attorney, Agent, or Firm*—Stephen E. Feldman

(57) ABSTRACT

A device for illuminating fluorescent art includes a UV light source, a white light source, a UV sub-housing and a white light sub-housing. The UV light source is contained in the UV sub housing and the white light source is contained in the white light sub-housing so that the white light source is separated from the UV light source. This configuration prevents interference between the UV light source and the white light source within the device.

4 Claims, 3 Drawing Sheets

MACHINE FOR ILLUMINATING FLUORESCENT ART

CROSS REFERENCE TO RELATED APPLICATION

This application is a continuation of application Ser. No. 10/160,892, filed Jun. 3, 2002, now abandoned which claimed priority to Japan Patent Office Application #2000-364303 "Lighting Equipment" by Tsuneo Tatsumi, patent pending as date of this application.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of art and more specifically to a machine for illuminating flourescent art and other objects.

Most of us are familiar with the "blacklight" (UV) posters available in the past few decades. Contemporary artists have now begun to incorporate long-life (museum quality) flourescent paints into fine art paintings and reproductions. Unfortunately, the display technology for this artwork has not kept pace. Since UV light is easily overpowered by stray white light in the area, the art is usually viewed in a dimly-lit area. However, this negates the normal viewing of the non-flourescent portions of the art. What is needed is a dual-light system wherein either UV light, or white light, or a combination of the two, can be conveniently and economically radiated onto the art subject.

No U.S. patents or patent applications specific to this invention are known. No commercially available similar lighting systems have been found on the market. In fact, this invention application is a direct result of that void. Of course, there are lighting systems which offer changing colored filters, or two identical light bulbs in one fixture, or different colored light bulbs in one fixture. But none of these serve the purpose. An attempt was made by the inventor (K Shotwell) to alter a commercially available picture light fixture to include two bulbs (UV and white light) and make them independently adjustable, but the only component of value in the commercially available system was the housing.

Typical artwork's flourescent highlights could of course be most easily viewed by simply holding a UV lamp near the art. However, this crude method offers no convenient or aesthetically pleasing mounting attachment. Neither does it offer any convenient manner to see the art under normal lighting (since the area must be dimly-lit to view the UV effects). Neither does it offer any variation in the combination of the UV and white lights. Nor is it practical in a museum or gallery environment.

IMPORTANT: One of the co-inventors listed here, Tsuneo Tatsumi, has a patent-pending version of a lighting system for art lighting in Japan. In fact, he was instrumental in initiating this U.S. patent, realizing the differences in the U.S. and Japanese marketplace for such a light system. Mr. Tatsumi realizes how different this new patent application is from his patent-pending version, and gives his support to this much more simple and economic U.S. version. Reference Japan Patent Office application #2000-364303 titled "Lighting Equipment".

Prior technology is not known to exist in a SIMPLE single system. Special consideration was paid at each step of the design process in this new patent application to insure simplicity and low cost for the consumer market. Previous similar inventions or products are too expensive, complex, heavy, difficult to manufacture, inconvenient to operate, prone to unreliability, unlikely to ever be portable (battery-operated), and generally unacceptable in the U.S. consumer marketplace.

Prior technology is also seen as too specific in scope. This new patent application describes a UV/white light system which is general in purpose, and has applications outside the realm of art display.

BRIEF SUMMARY OF THE INVENTION

The primary object of the invention is to provide a UV/white light system allowing convenient and inexpensive illumination of a flourescent object (primarily artwork).

Another object of the invention is to provide a UV/white light system which is electrically and physically simple, reliable, and easy to use.

Another object of the invention is to provide a UV/white light system that is easy and economical to manufacture and assemble.

A related object stems from the design phase of the system and assures elimination of complex electronics and printed circuits, and assures a minimum of components which require custom manufacturing.

A further object of the invention is to provide a UV/white light system that is lightweight, attractive, and potentially portable.

Yet another object of the invention is to provide a UV/white light system featuring independently adjustable light intensities for use in dimly lit areas.

Still yet another object of the invention is to provide a UV/white light system enabling UV light, white light, or combination effects of the light sources, within one system, allowing maximum viewing drama.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine for illuminating flourescent art comprising: a UV light source for illuminating flourescent inks, dyes, or paints, a white light source for general illumination in a dimly lit area, a power supply (transformer/ballast/ignitor) to activate tubular bulbs where required, a switching system enabling the light sources to be activated independently or in adjustable intensity combination, and a housing for convenience of use.

Alternate embodiments allow for freestanding renditions of the design such as a pedestal mount. Other embodiments suggest the invention as an integral part of the object to be illuminated (such as built into a picture frame). Another option is portability of the invention, assuming battery-operation.

Illumination of objects other than art is within the scope of this invention.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The reader will recall the environment in which this discussed version of the invention is envisioned to be used; a museum, home, gallery, or perhaps a store display, denoting a preferably dimly-lit area in order to emphasize the flourescent effects of the illuminated object, in this case, a painting or reproduction created using both traditional and flourescent paints, inks, dyes, and/or media substrates. In addition, an assumption is made that the traditional design of a commercially available, white light only, picture light fixture is generally known and recognized. A need exists to illuminate said art in a convenient, dramatic, and affordable manner, to which end this invention succeeds. A prototype of the invention exists and has been publically introduced prior to the date of this application.

Figure 1:
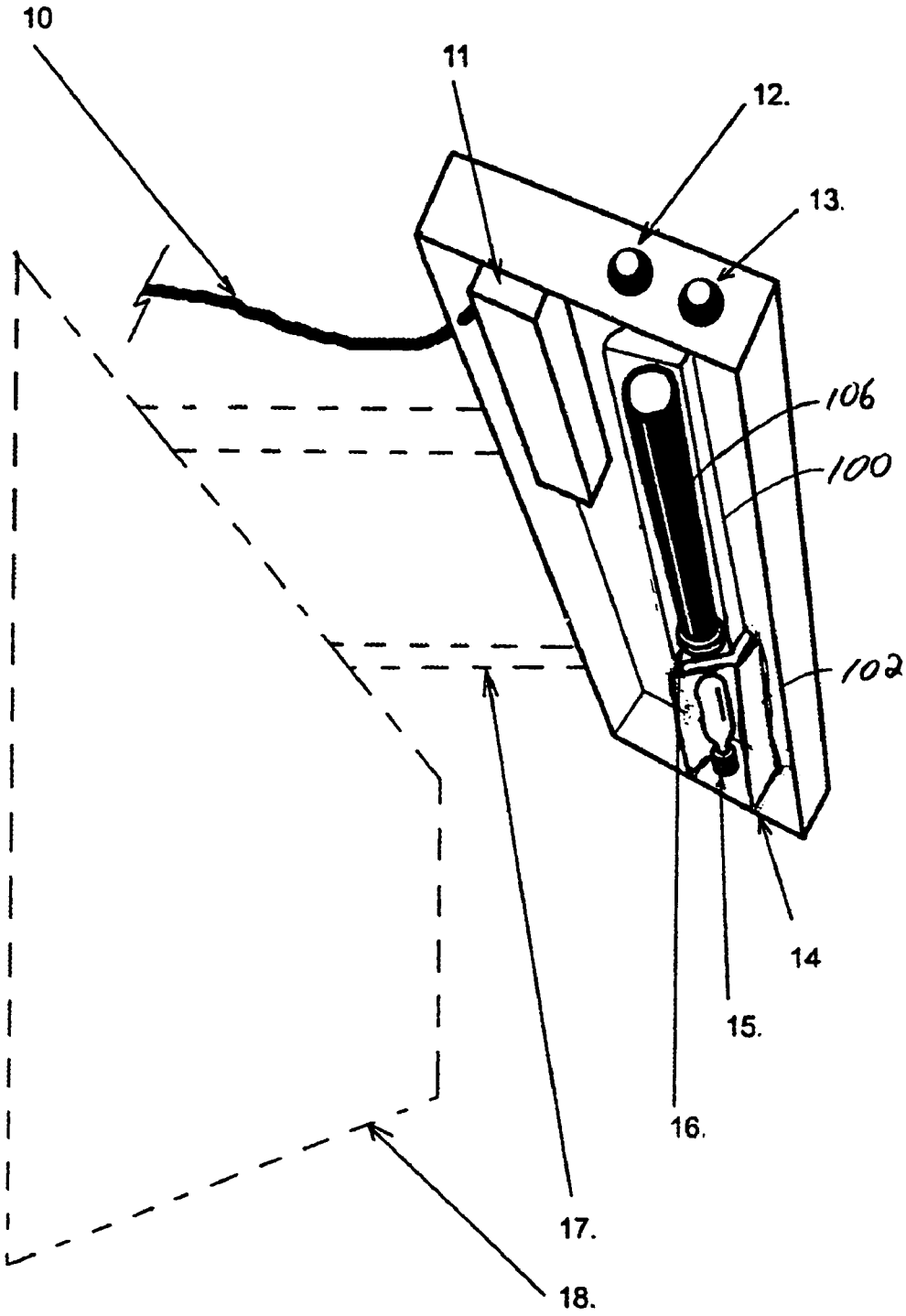
FIG. 1 is a perspective view of the invention.

FIG. 1, Item 15 WHITE LIGHT AND SOCKET broadly encompasses the currently available realm of "white" spectrum lamps, including but not limited to, halogen, incandescent, white tubular, and other types offered commercially. This white lamp (or multiple white lamps) produces the white light for normal viewing of art. Generally, halogen is considered to yield the most true hues, however halogen lamps are relatively hot under normal operation and as such would require a heat shield to protect surrounding heat-sensitive components. Such a heat shield could also serve as a reflector to direct the light. A heat shield is not shown in FIG. 1 since a halogen lamp is not absolutely necessary to the invention. Said Item 15 infers that the light source be, in the preferred embodiment, a white light source. The socket of such a light source would be as varied as the type of bulb, and as such is given no further definative detail in FIG. 1. Prototype experience has shown that for an average size artwork (less than 24×30 inches), a white light source of 15 Watts is sufficient for a halogen, 40 Watts is sufficient for a white tubular, and approximately 40 Watts is sufficient for an incandescent bulb, though bulb wattages depend on the ambient light environment of the invention.

White light sources are routinely used in traditional picture lamps. This invention requires at least one more different type of light source within the system, in the case of the preferred embodiment of FIG. 1, an ultraviolet (UV) lamp, to serve the purpose of emphasizing the flourescent accents within the artwork. Persuant to this invention, the white lamp is the logical candidate to be dimmed and/or turned off to allow the Item 16 UV LIGHT AND SOCKET to dominate the illuminated art. Two reasons for this candidacy exist. First, most commercially available UV lamps (and particularly the best quality UV lamps) are tubular flourescents, and do not readily lend themselves to electronic dimming (with the possible exception of recently available "screw-in" tubular UV bulbs, which contain a transformer and starter, or ballast, built into the unit base). Second, the dimming of a UV light in the presence of a strong white light is barely noticeable.

The above paragraphs logically suggest a discussion of the electrical controls for the UV and white lamps. In FIG. 1, note first Item 12 ON-OFF SWITCH FOR UV LIGHT. In its envisioned preferred embodiment, the basic on-off switch is the most logical, simple, and economical manner to control the UV light in this invention, far reasons cited above. In actuality, it is the Item 11 UV POWER SUPPLY which is turned on or off. This is due, in part, to the inherent need for a power supply, and ignitor or "starter" in the circuit of most tubular flourescent bulbs. Prototype experience has shown that for an average size artwork (less than 24×30 inches), a UV source of at least 15 Watts is preferable. Of course, the wattage of both the UV light and the white light is a function of the size of the object being illuminated, and the distance from the object to the invention. For reasons cited above, the socket of Item 16 UV LIGHT AND SOCKET is shown only schematically in FIG. 1. It could be a traditional double ended pin type, a single ended pin type, or possibly a screw base type or some other type; the socket type is inconsequential to this invention.

As for the white light control, Item 13 ON-OFF DIMMER FOR WHITE LIGHT, a design choice is implied between a simple on-off switch or a dimmer. Either choice would yield a change in the overall illumination field from white light to UV light and back to white light. An on-off switch choice here would yield an abrupt lighting change. A dimmer yields a more gradual, dramatic, and "emotional" change usually desireable to an art viewer. Note that since UV light is easily overpowered by white light, the UV light may remain on in most foreseen light-altering adjustments. The only envisioned instances wherein the UV lamp would be turned off is either when the effects of fluorescence are not desired, or when the entire invention is turned off. Obviously, and conversely, the only time the UV light would be on without the white light being activated, would be when ONLY flourescent effects were desired.

To summarize thus far, the invention fills a need to view objects, in this case, art, which have flourescent highlights, in a convenient, affordable, and controllable manner. The oversimplification of FIG. 1 is intentional, in part, since the circuitry, components, and logistics of all components is common knowledge to any lighting manufacturer. Claims and drawings of this invention generally emphasize commonplace hardware components, but in a unique combination and system envelope, Item 14 HOUSING. The shape of the housing is generally inconsequential. Though not envisioned as a consumer-friendly option, the invention could feasibly be battery powered, and thus portable. Battery life is suspect. Alternative free-standing, or built-into-picture-frame embodiments are possible.

In addition, the control Items 12 and 13 could be motorized, remotely activated, and/or activated by pressure-sensitive or other type switches without compromising this invention intent. However, this is considered to be counter to the goal of a simple, affordable, and reliable invention. An option to the control Items 12 and 13 could be a mechanical "shade" positioned alternately over the UV lamp or the white lamp. This would achieve a similar effect in this invention. However, this introduces a moving part, considered costly in this application, but otherwise acceptable as an alternative to an electrical dimmer, as described in Dependent Claims.

Concerning the design and appearance of the invention, the relative position of Items 10 through 16 in FIG. 1 are, in some respects, inconsequential, as long as they are convenient, effective, and safe within the Item 14 HOUSING. Underwriters Laboratories would normally review the design assuring, for instance, that controls were not near hot bulbs, that housing and internal components were heat resistant, flame-retardant, and/or heat shield-protected, where necessary, that proper wiring sizes were incorporated, that shatter-prone bulbs (such as halogen-type) were safely screen-protected, etc. Concerning the logistics of component placement within the housing, controls on the end of the housing rather than in mid-section, offer a more unobstructed view of the object being illuminated, while performing lighting adjustments, though this is an observation, not a requirement. Also, the housing would preferable be light-proof on all sides except the side facing the object to be illuminated, in order to minimize the visual distraction of stray light escaping the housing.

Possible additional uses for this invention, in its preferred embodiment, FIG. 1, are limited. Examples include paintings and reproductions, some relief sculptures, 2-dimensional displays, graphic presentations, murals, photography, and other special effect objects, assuming each of the examples has a flourescent feature to highlight However, simple modifications to the invention such as FIG. 2 ALTERNATE EMBODIMENT OF THE INVENTION, involving a pedestal or other type of support including hand-held, suggest a wider scope of objects to be illuminated, including but not limited to, 3-dimensional promotional displays, counterfeit currency scans, organic substance and medical inspections, organic compound and/or substrate material scans, and any situation where an alternating and adjustable UV/white light source is desireable.

Incorporating minor changes into the configuration of the invention results in a variety of alternative uses. One example involves substitution of an infrared (heat) lamp for the white lamp. This would result in a future now comprising a UV light and an infrared light, which would be useful in, for instance, assembly line curing of certain hi-tech adhesives. Further, if the housing and components were considerably smaller in scale, uses could include medical situations involving adhesive curing or even general illumination, such as dentistry or other surgery involving multiple-light source needs. Another alternate use of the invention involves replacing the 2 minimum lamps (UV and white light) with, say, three standard colored bulbs of primary colors red, yellow, and blue. Using such an invention configuration would enable a photographer, for instance, to illuminate a subject in a wide variety of trial ambient colors (created by combinations of the primary colors) before deciding on a lighting choice for the final shot. In fact, extrapolating the realm of light sources to include laser, fiber-optic, quartz-iodine, neon, and/or other "exotic" lamps, the possibilities for an invention with singular housing and near infinite control capabilities for light intensity and combination, yields numerous possibilities.

Repeating the advantages of the invention over previous technology (assuming FIG. 1 embodiment), the invention offers convenience, affordability, reliability, simplicity, potential portability, relative ease of manufacture, and can be easily altered to adapt to new uses. The invention offers adjustable, combinational light effects which are easily controlled, and does so as a single system. It is important to note that no known, inexpensive (relative to the artwork) light fixture currently commercially available to the average consumer offers a minimum of two DIFFERENT and independently adjustable light sources, in one simple system, for the intended, or any other known use.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

FIG. 1 shows a device for illuminating a piece of artwork 18 according to an embodiment of the present invention. A housing 14 contains a UV sub-housing 100 and a white light sub-housing 102. The UV sub-housing 100 has a UV light bulb 106 set into a UV socket 16 and the white light sub-housing 102 has a white light bulb and socket arrangement 15. Preferably, each sub-housing 100 and 102 is highly reflective over its respective inner surface.

The sub-housings 100 and 102 isolate the UV light bulb from the white light source 15 to prevent interference between the UV light source 106 and the white light source 15 in the housing 14. The sub-housings 100 and 102 focus their respective light sources with a highly reflective interior surface that surrounds a portion of its respective bulb. Preferably, both light sources are recessed into their respective sub-housing so that the bulb does not protrude from the sub-housing, and therefore, from the housing 14. In addition, each sub-housing may be designed with a swiveling attachment so that each light source may be directed individually and independently.

A dimming switch 12 controls current flow to the white light socket and bulb arrangement 15. An on/off switch 13 controls current to the UV light source 106 via a UV power supply 11, which, in turn, is operably connected to an electricity source via a cord 10. Mounting arms 17 are used to position the housing 14, and therefore the two light sources contained therein, over a piece of artwork 18.

Figure 2:
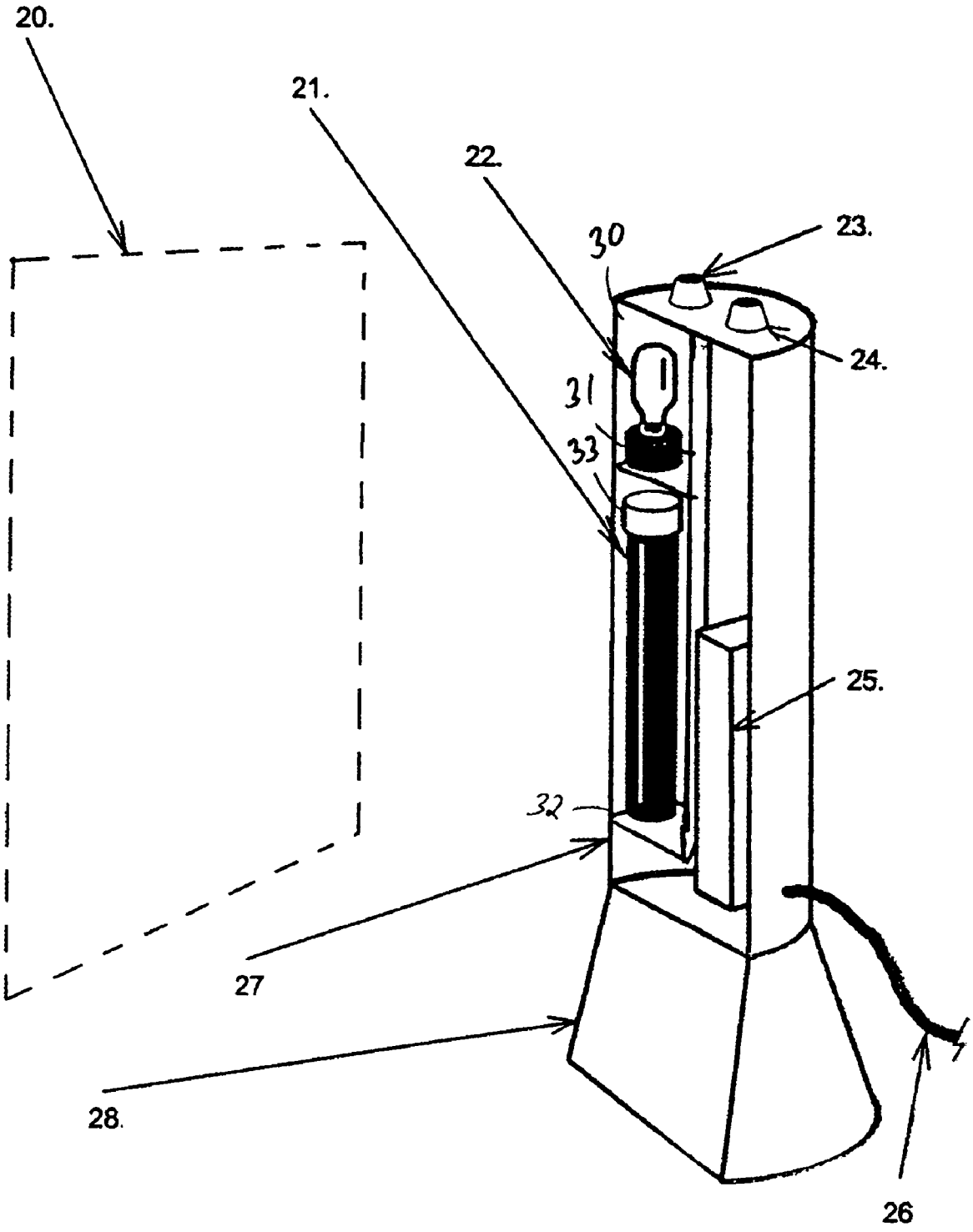
FIG. 2 is an alternate embodiment of the invention.

FIG. 2 shows an alternate, floor-standing embodiment of the device in FIG. 1 with a pedestal 28 positioned to illuminate a piece of artwork 20. The housing 27 contains a white light sub-housing 30 with a white light bulb 22 and a white light socket 31, and a UV light sub-housing 32 with a UV light bulb 21 and a UV light socket 33. A dimming switch 23 controls current flow to the white light bulb 22 via the socket 31. An on/off switch 24 controls current flow to the UV light bulb 21 via the UV power supply 25 and the UV light socket 33. Electricity is provided from an electrical cord 26 plugged into an electrical outlet or hooked up to a battery.

Figure 3:
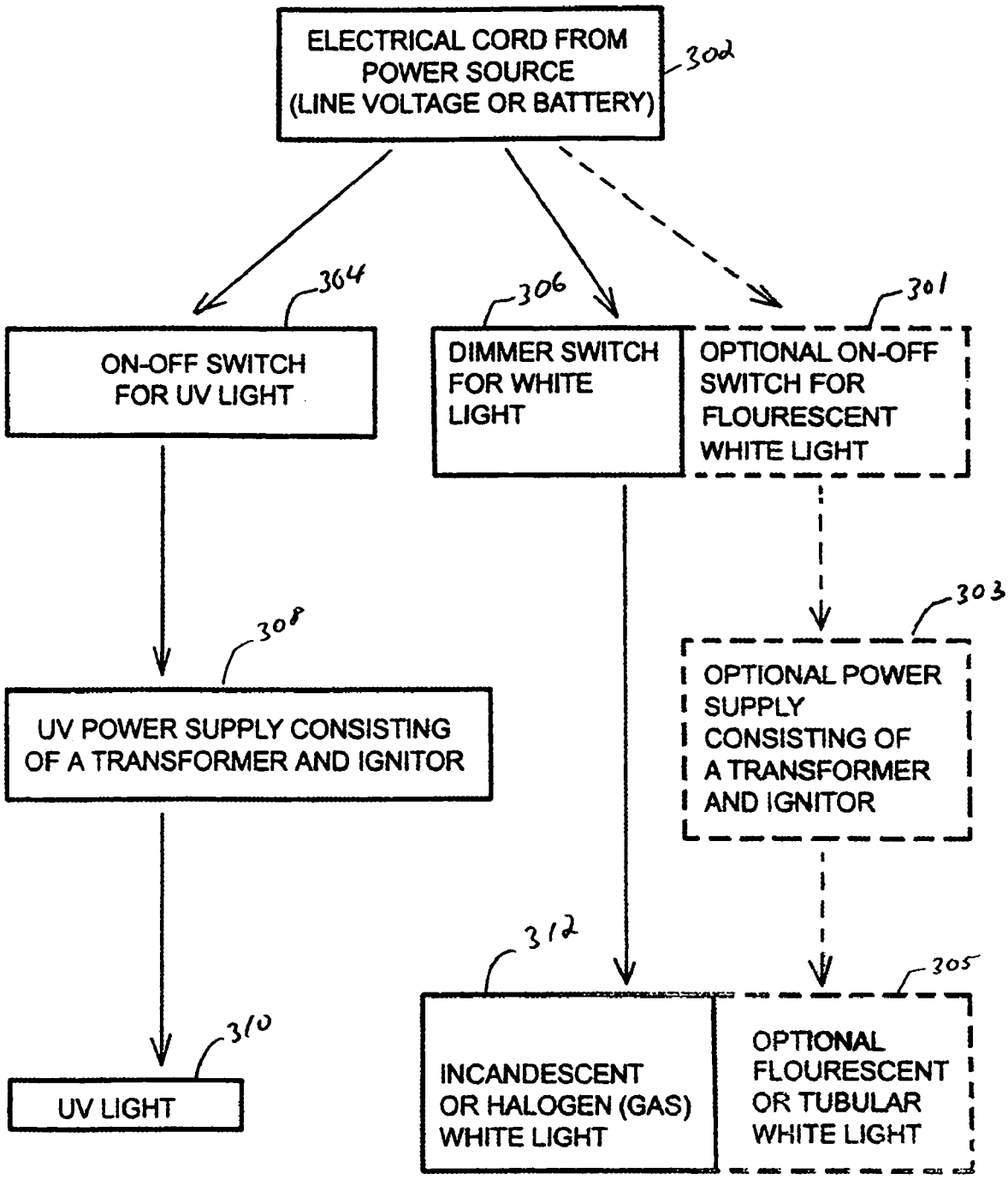
FIG. 3 is an electrical block diagram of the invention.

FIG. 3 shows an electrical block diagram for the electrical connections in a device according to an embodiment of the present invention. The dashed line is an alternate configuration of the white light connection. An electrical cord 302 supplies electricity from a source such as an outlet or battery to an on-off UV switch 304 and to a white light dimmer switch 306. A UV power supply with a transformer and ignitor 308 supplies electricity through the switch 308 to the UV light 310.

The white light connection configuration depends on the type of white light used. If an incandescent or halogen bulb 312 is selected, it may be dimmed, and so is simply connected to a dimmer switch 306. Fluorescent white lights are usually not dimmed, so an on-off switch 301 is provided and the bulb 305 is powered via a power supply with a transformer and ignitor 303.

What is claimed is:

1. A device for illuminating fluorescent art comprising:

a UV light source;

a white light source;

a UV sub-housing;

a white light sub-housing; and a UV swivel attachment constructed and arranged to mount the UV sub-housing into the device so that the UV light source may be directed at a specific angle, wherein:

the UV light source is contained in the UV sub housing and the white light source is contained in the white light sub-housing so that the white light source is separated from the UV light source, preventing interference between the UV light source and the white light source within the device.

2. A device for illuminating fluorescent art comprising:

a UV light source;

a white light source;

a UV sub-housing;

a white light sub-housing; and a white swivel attachment constructed and arranged to mount the white light sub-housing into the device so that the white light source may be directed at a specific angle, wherein:

the UV light source is contained in the UV sub housing and the white light source is contained in the white light sub-housing so that the white light source is separated from the UV light source, preventing interference between the UV light source and the white light source within the device.

3. A device for illuminating fluorescent art comprising:

a UV power supply;

a UV light socket;

an on-off switch;

a white light socket;

a white light switch;

a housing; a UV light source; a UV sub-housing; a white light source; a white light sub-housing; wherein: the UV light source is contained in the UV sub housing and the white light source is contained in the white light sub-housing so that the white light source is separated from the UV light source, preventing interference between the UV light source and the white light source within the device; and a UV swivel attachment constructed and arranged to mount the UV sub-housing into the frame so that the UV light source may be directed at a specific angle, wherein: the UV light source is operably connected to the UV light socket and the UV light socket is operably connected to the UV power supply via the on-off switch; the white light source is operably connected to the white light socket and the white light socket is operably connected to the white light switch, the white light switch being constructed and arranged to operably connect to a power source; and, the housing contains the UV light source, the UV power supply, the UV light socket, the on-off switch, the white light source, the white light socket and the white light switch, and the housing is integrated into the frame to illuminate the external surface of a piece of art in the frame.

4. A device for illuminating fluorescent art comprising:

a UV power supply;

a UV light socket;

an on-off switch;

a white light socket;

a white light switch;

a housing; a UV light source; a UV sub-housing; a white light source; a white light sub-housing; wherein: the UV light source is contained in the UV sub housing and the white light source is contained in the white light sub-housing so that the white light source is separated from the UV light source, preventing interference between the UV light source and the white light source within the device; and a white swivel attachment constructed and arranged to mount the white light sub-housing into the frame so that the white light source may be directed at a specific angle, wherein: the UV light source is operably connected to the UV light socket and the UV light socket is operably connected to the UV power supply via the on-off switch; the white light source is operably connected to the white light socket and the white light socket is operably connected to the white light switch, the white light switch being constructed and arranged to operably connect to a power source; and, the housing contains the UV light source, the UV power supply, the UV light socket, the on-off switch, the white light source, the white light socket and the white light switch, and the housing is integrated into the frame to illuminate the external surface of a piece of art in the frame.

* * * * *